US011745254B2

(12) United States Patent
Fargeas et al.

(10) Patent No.: US 11,745,254 B2
(45) Date of Patent: Sep. 5, 2023

(54) FOUNDRY MOLD, METHOD FOR MANUFACTURING THE MOLD AND FOUNDRY METHOD

(71) Applicant: SAFRAN AIRCRAFT ENGINES, Paris (FR)

(72) Inventors: Serge Alain Fargeas, Moissy-Cramayel (FR); Nicolas Romain Benjamin Leriche, Moissy-Cramayel (FR); Dominique Joseph Georges Coyez, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/756,288

(22) PCT Filed: Nov. 13, 2020

(86) PCT No.: PCT/FR2020/052078
§ 371 (c)(1),
(2) Date: May 20, 2022

(87) PCT Pub. No.: WO2021/099721
PCT Pub. Date: May 27, 2021

(65) Prior Publication Data

US 2022/0410254 A1 Dec. 29, 2022

(30) Foreign Application Priority Data

Nov. 21, 2019 (FR) ..... 1912996

(51) Int. Cl.
*B22C 9/08* (2006.01)
*B22C 9/04* (2006.01)
*B22D 27/04* (2006.01)

(52) U.S. Cl.
CPC ..... *B22C 9/082* (2013.01); *B22C 9/043* (2013.01); *B22D 27/04* (2013.01)

(58) Field of Classification Search
CPC ..... B22C 9/082; B22C 9/043; B22C 9/08; B22D 27/04
See application file for complete search history.

(56) References Cited

U.S. PATENT DOCUMENTS

2014/0262107 A1 9/2014 Hanrahan et al.
2019/0337047 A1 11/2019 Klaus et al.

FOREIGN PATENT DOCUMENTS

FR 2 985 925 A1 7/2013
JP 56-154250 A 11/1981
(Continued)

OTHER PUBLICATIONS

International Search Report and Written Opinion dated Jan. 21, 2021 in International Application No. PCT/FR2020/052078 with English Translation of the International Search Report (29 pages).
(Continued)

*Primary Examiner* — Kevin P Kerns
*Assistant Examiner* — Steven S Ha
(74) *Attorney, Agent, or Firm* — Bookoff McAndrews, PLLC

(57) ABSTRACT

A foundry mold includes at least one molding cavity and one pair of feeder arms. The molding cavity extends, along a horizontal axis, from a first end to a second end, and the first pair of feeder arms comprises a first feeder arm, oriented in a substantially vertical direction and connected to the first end of the first molding cavity, and a second feeder arm, substantially parallel to the first feeder arm and connected to the second end of the first molding cavity.

11 Claims, 6 Drawing Sheets

(56) References Cited

FOREIGN PATENT DOCUMENTS

| | | | |
|---|---|---|---|
| JP | 57-1539 | A | 1/1982 |
| WO | 2018/215735 | A1 | 11/2018 |

OTHER PUBLICATIONS

R. Wlodawer, "Directional Solidification of Steel Castings", Copyright © 1966 Pergamon Press Ltd, pp. 69-71.

[Fig. 1A]
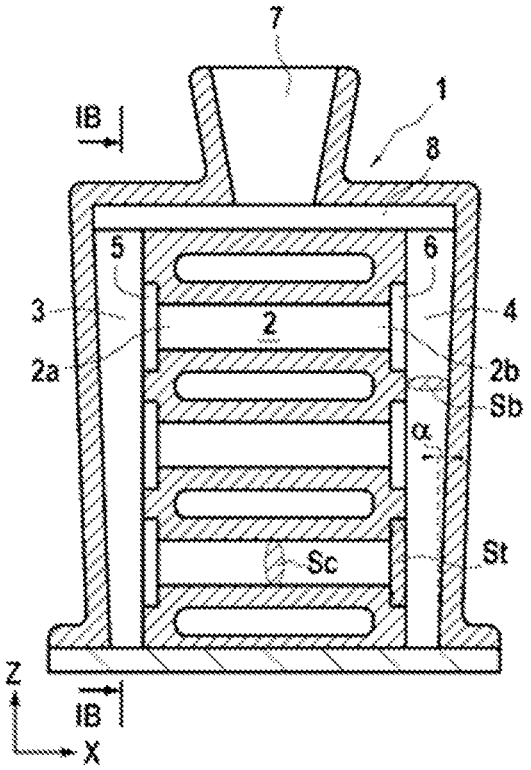
[Fig. 1B]
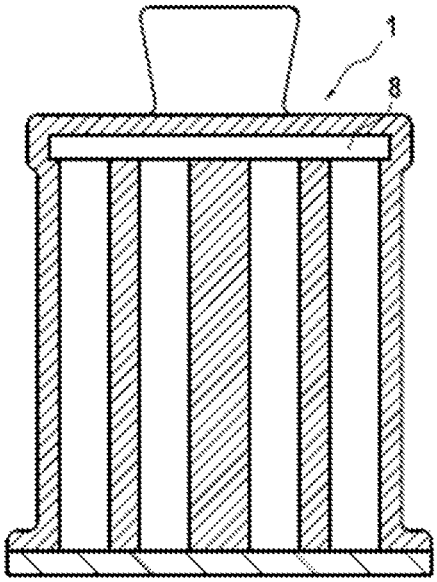

[Fig. 2A]
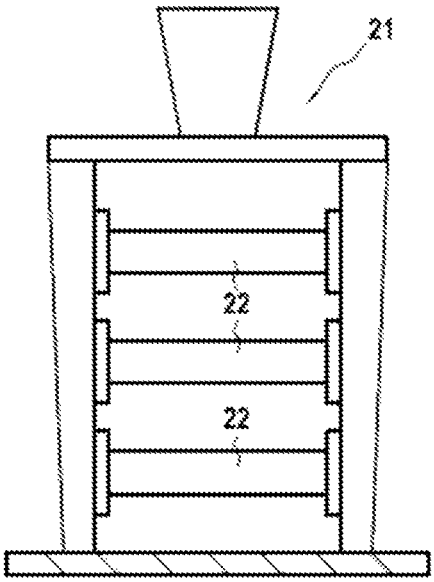
[Fig. 2B]
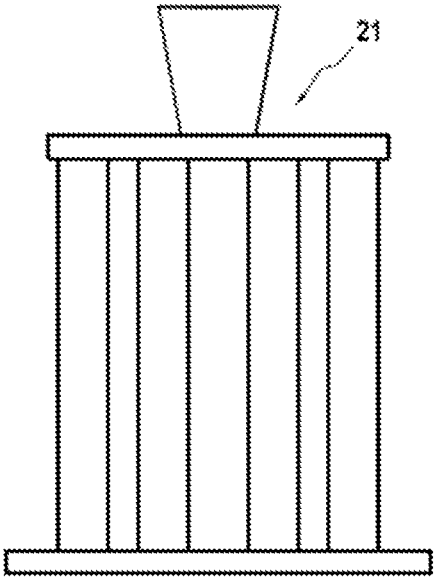

[Fig. 3A]
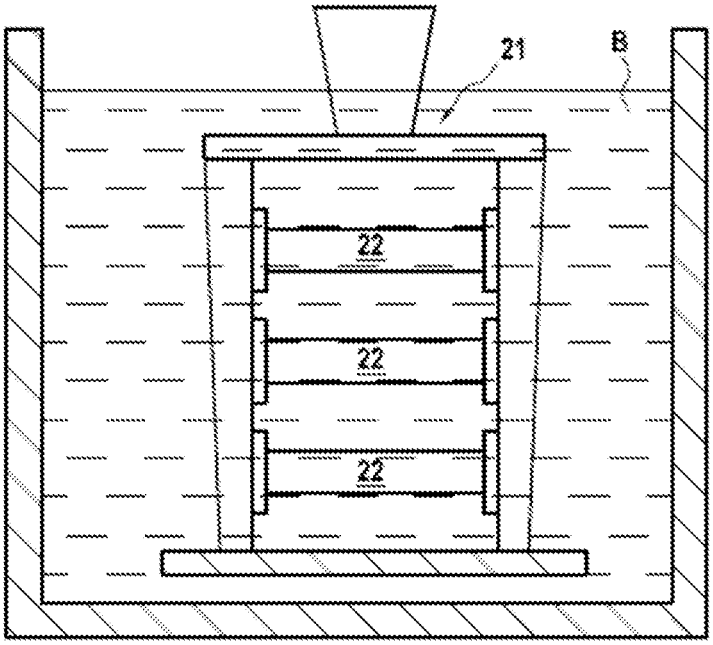
[Fig. 3B]
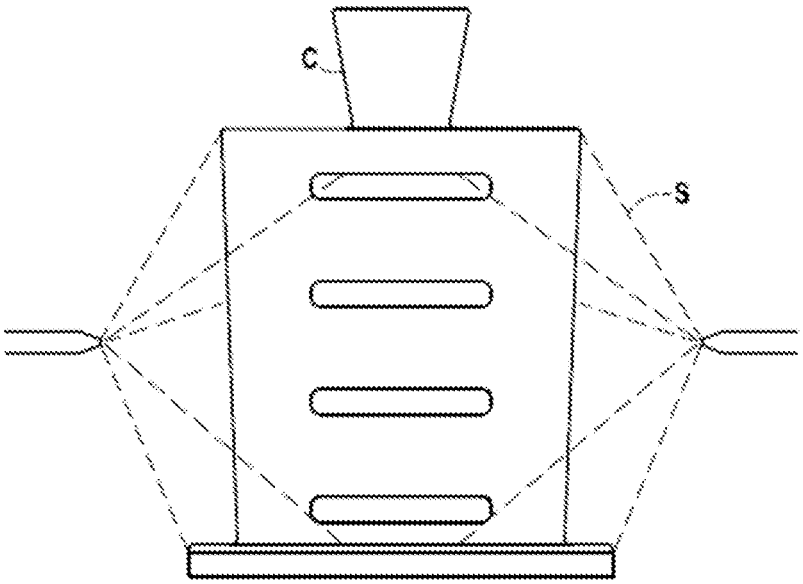

[Fig. 3C]
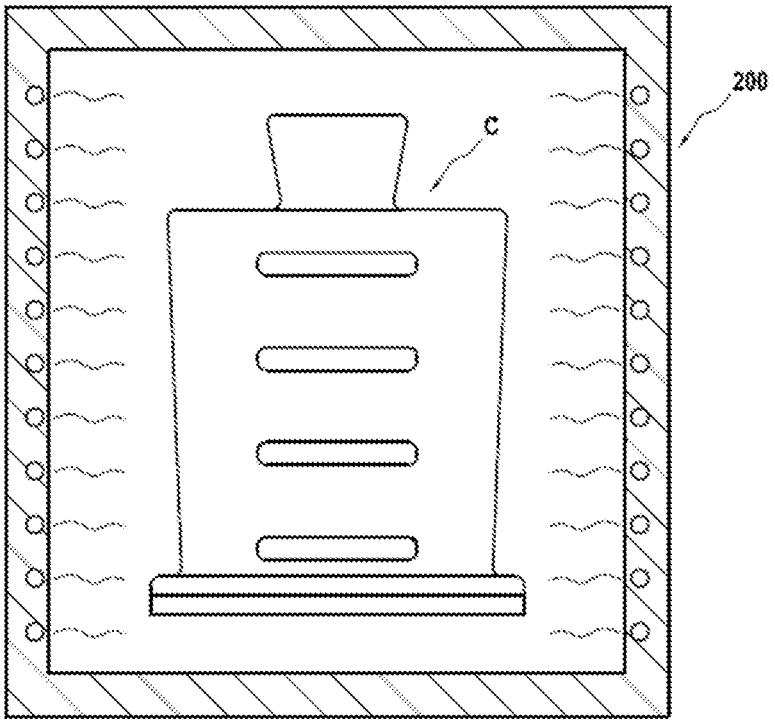
[Fig. 4A]
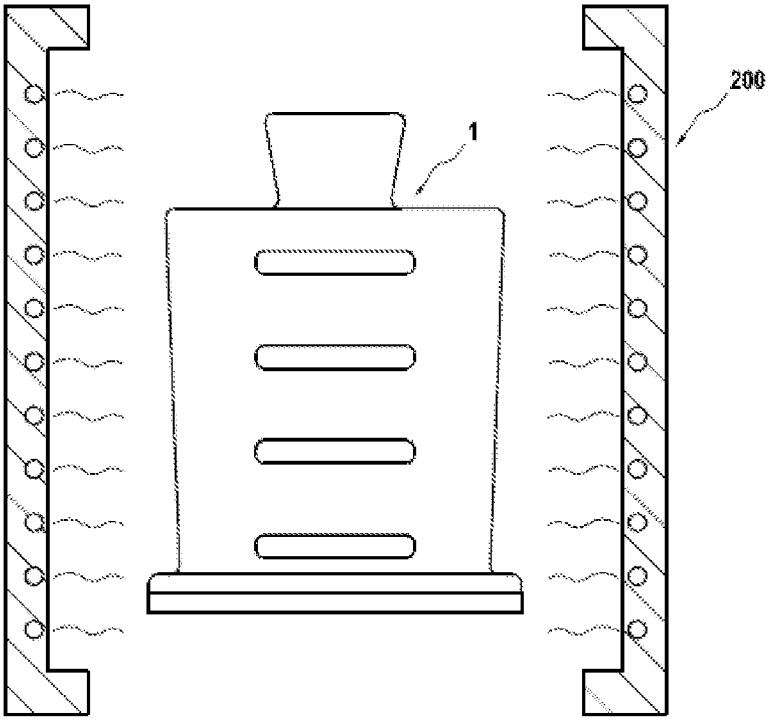

[Fig. 4B]
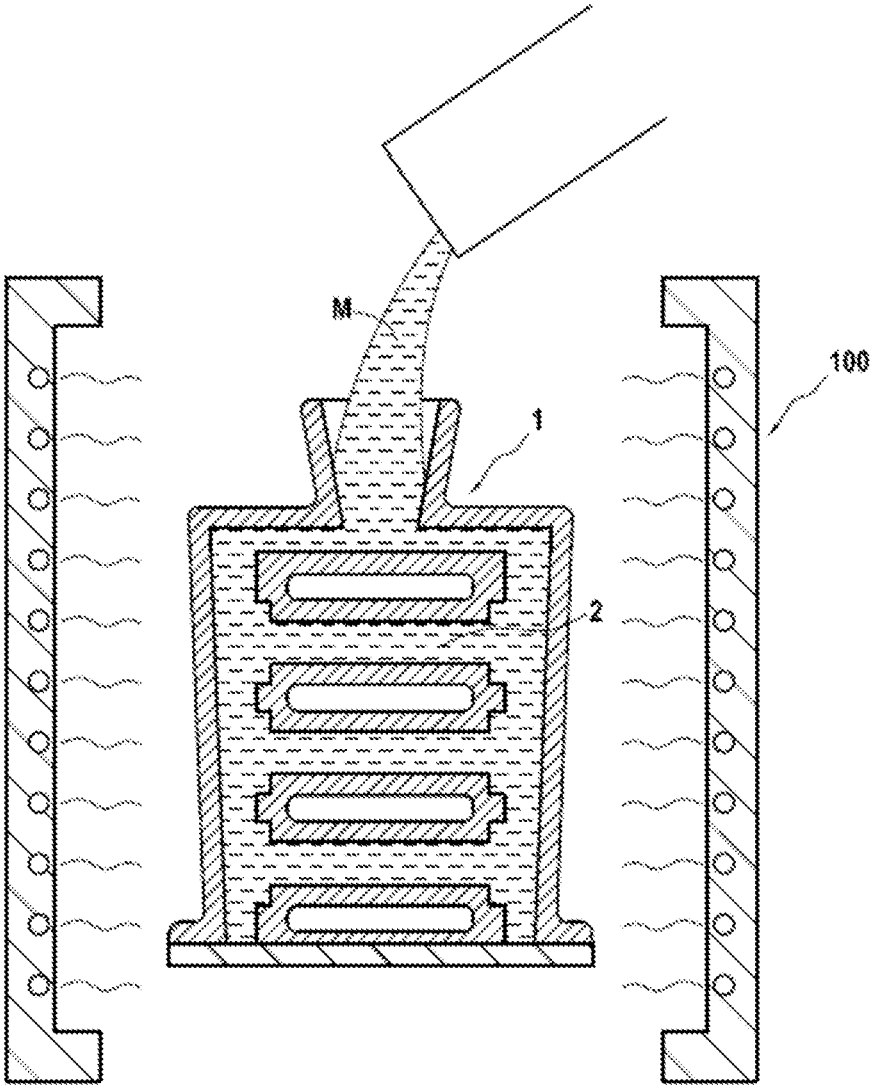

[Fig. 4C]
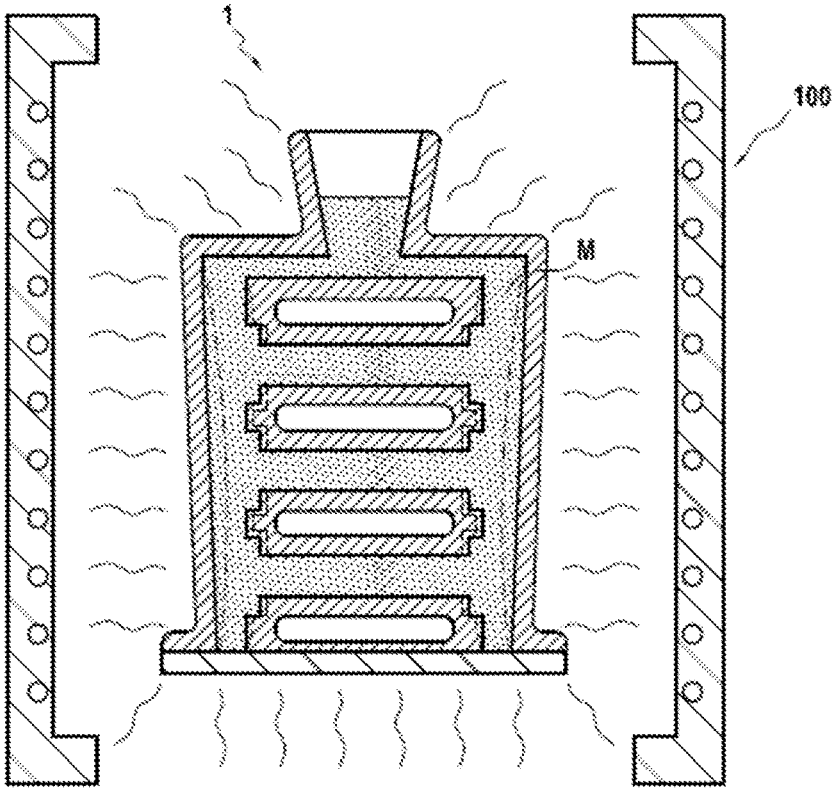
[Fig. 4D]
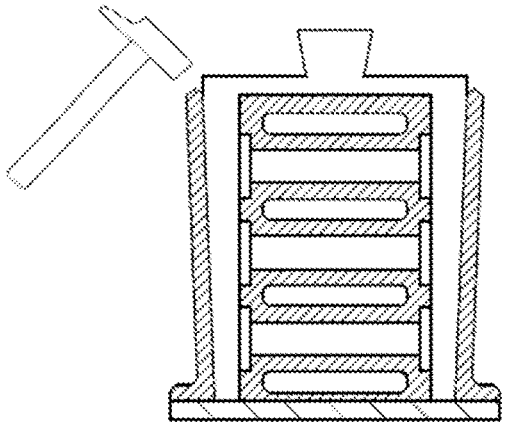
[Fig. 5]
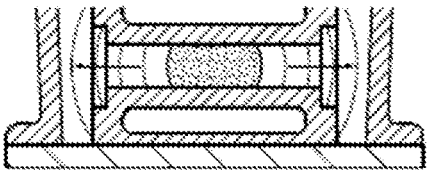

FOUNDRY MOLD, METHOD FOR MANUFACTURING THE MOLD AND FOUNDRY METHOD

CROSS-REFERENCE TO RELATED APPLICATIONS

This application is a National Stage Application of International Application PCT/FR2020/052078, filed on Nov. 13, 2020, now published as WO 2021/099721 A1, and which claims priority to French patent application FR1912996, filed on Nov. 21, 2019.

TECHNICAL FIELD

The present disclosure relates to the field of metal casting. What is meant by "metal" in the present context is both pure metals and metallic alloys.

PRIOR ART

With known casting methods, including at least one step of pouring a metal in the liquid state into a molding cavity through a gate leading into one end of the molding cavity, followed by cooling and solidification of the metal in the molding cavity prior to demolding the solidified metal, defects can be encountered, particularly during the production of parts with particularly thin portions, such as for example the trailing edges of the turbine engine blades. In fact, during the cooling of the metal in the mold, the different contraction rates of the metal and of the material of the mold can generate mechanical stresses until defects, particularly cracks, appear in the solidified metal.

In particular, when the part to be molded has a central portion that is narrower than its ends, which is often the case, for example for turbine engine blades extending along a main axis, from a blade root to a blade tip, the mold can retain these ends during the cooling and the contraction of the solidified metal. This then generates tension forces in the part which can generate cracks and local recrystallization, particularly in the transitions between the ends and the central portion of the part. This phenomenon can be further aggravated by a temperature gradient along the molding cavity, between the end connected to the gate and a closed opposite end.

DISCLOSURE OF THE INVENTION

The present disclosure seeks to remedy these disadvantages by proposing a foundry mold which will allow reducing the cracks and recrystallization phenomena due to internal tensions caused, during the cooling of the metal in the mold, by differences between the thermal contraction rate of the metal and of the mold.

To this end, according to a first aspect, the mold can include at least a first molding cavity extending, along a horizontal main axis, from a first end to a second end, and a first pair of feeder arms. A first feeder arm of the first pair of feeder arms can be oriented with a main axis in a substantially vertical direction and connected to the first end of the first molding cavity, while a main axis of a second feeder arm of the first pair of feeder arms can be substantially parallel to the first feeder arm and connected to the second end of the first molding cavity. The mold can be configured so that any transverse section of the first and second feeder arms of the first pair of feeder arms, perpendicular to a vertical axis, has a greater area than any transverse section of the molding cavity perpendicular to the horizontal axis.

Due to the arrangement of a feeder arm at each end of the molding cavity, the thermal contraction of the metal in these feeder arms will cause them to buckle toward one another, which will allow balancing the forces generated by the thermal contraction of the metal in the first molding cavity, thus avoiding the appearance of cracks and recrystallized grains which can weaken the part thus molded. Due to the evolution of the areas of the transverse sections of the molding cavity and of the feeder arms, the solidification of the metal, beginning with the core of the first molding cavity where the transverse section is smallest, can propagate toward that through the two feeder arms through transverse sections with increasing areas so as to avoid piping defects due to constrictions in the cavities of the mold.

According to a second aspect, the mold can comprise docking heads connecting the first and second ends of the first molding cavity to the respective feeder arms of the first pair of feeder arms, each docking head having a transverse section, perpendicular to the horizontal axis, with an area greater than any transverse section of the first molding cavity perpendicular to the horizontal axis, but smaller than any transverse section of the first and second feeder arms of the first pair of feeder arms perpendicular to the vertical axis. In addition, in the same sense, the first and second feeder arms of the first pair of feeder arms can have transverse sections, perpendicular to the vertical axis, with areas increasing upward along the vertical axis.

According to a third aspect, in order to allow the simultaneous molding of several parts in the same mold, the mold can comprise a first row of molding cavities, including the first molding cavity, each molding cavity of the first row of molding cavities extending, along a respective horizontal axis, from a first end to a respective second end, the first end of each molding cavity of the first row of molding cavities being connected to the first feeder arm of the first pair of feeder arms, and the second end of each molding cavity of the first row of molding cavities being connected to the second feeder arm of the first pair of feeder arms. Thus, a part can be formed in each molding cavity of the first row of molding cavities between the feeder arms of the first pair of feeder arms. Moreover, to avoid piping flaws, the mold can be configured in such a way that any transverse section of the first and second feeder arms of the first pair of feeder arms, perpendicular to a vertical axis, is greater than any transverse section of each molding cavity of the first plurality of molding cavities perpendicular to the respective horizontal axis.

In addition, in order to allow the simultaneous molding of even more parts in the same mold, the mold can comprise at least a second row of molding cavities and a second pair of feeder arms, each molding cavity of the second row of molding cavities extending, along a respective horizontal axis, from a first end to a respective second end, the first end of each molding cavity of the second row of molding cavities being connected to the first feeder arm of the second pair of feeder arms, and the second end of each molding cavity of the second row of molding cavities being connected to the second feeder arm of the second pair of feeder arms. Moreover, in order to avoid piping defects in the parts formed in this second row of molding cavities, the mold can be configured so that any transverse section of the first and second feeder arms of the second pair of feeder arms, perpendicular to a vertical axis, is also larger than any transverse section of each molding cavity of the second row of molding cavities perpendicular to the respective horizontal axis.

According to a fourth aspect, in order to ensure the feeding of the molding cavities with liquid metal during the pour, upper ends of the feeder arms can be connected to a gate, for example by channels for feeding liquid metal.

According to a fifth aspect, at least the first molding cavity can be configured to mold a turbine engine blade extending from a blade tip to a blade root along the horizontal axis. What is meant by a "turbine engine" in this context is any machine in which a transfer of energy can occur between a fluid flow and at least one blading, such as for example a compressor, a pump, a turbine, a propeller or even a combination of at least two of these. To transmit this energy between the blading and a rotating shaft, this blade typically forms a part of a rotor including a trunion and a plurality of blades each extending radially from a blade root to a blade tip in a corresponding radial direction relative an axis of rotation of the trunion. These blades being subjected to particularly high mechanical and thermal forces, and being able to have, particularly at their trailing edges, particularly thin material thicknesses, it is particularly desirable in this field to avoid any local defect such as a crack, piping or recrystallization.

According to a sixth aspect, the mold can be configured as a shell mold. What is meant by "shell mold" is a mold formed by granules of a refractory material bonded by a slurry baked around the cavities of the mold. The mold can in particular be formed by a plurality of superimposed layers, each comprising granules bonded by the slurry.

A seventh aspect of this disclosure relates to a method for producing this mold, comprising steps of dipping a non-permanent pattern in a slurry, dusting the non-permanent pattern, after dipping, with granules of a refractory material to form a layer of granules of refractory material coated with slurry, removal of the non-permanent pattern from a shell formed by the granules of refractory material coated with slurry, and baking the shell.

An eighth aspect of this disclosure relates to a casting method comprising the steps of pouring a metal in the liquid state into a foundry mold of this type, cooling and solidification of the metal in the mold, and demolding of the solidified metal. Moreover, this method can also comprise a step of preheating the mold in an oven prior to the pouring step, and the mold being held in the oven until and during the pouring step. However, it can also be contemplated that the preheating step is carried out in a first oven, and the pouring step in a second oven, different from the first oven.

BRIEF DESCRIPTION OF THE DRAWINGS

The invention will be better understood and its advantages will appear more clearly upon reading the detailed description that follows, of an embodiment shown by way of a non-limiting example. The description refers to the appended drawings in which:

FIG. 1A is a first section view of a foundry mold according to one aspect of the invention, FIG. 1B is a section view, perpendicular to FIG. 1 in the plane IB-IB, FIG. 2A is a side view of a cluster of non-permanent patterns intended to form the mold of FIGS. 1A and 1B, FIG. 2B is a front view of the cluster of FIG. 2A, FIG. 3A illustrates a dipping step in a manufacturing method of the mold of FIGS. 1A and 1B starting with the cluster of FIGS. 2A and 2B, FIG. 3B illustrates a dusting step in the manufacturing method of the mold of FIGS. 1A and 1B starting with the cluster of FIGS. 2A and 2B, FIG. 3C illustrates a baking step in the manufacturing method of the mold of FIGS. 1A and 1B starting with the cluster of FIGS. 2A and 2B, FIG. 4A illustrates a pre-heating step in a casting method using the mold of FIGS. 1A and 1B, FIG. 4B illustrates a pouring step in the casting method using the mold of FIGS. 1A and 1B, FIG. 4C illustrates a cooling step in the casting method using the mold of FIGS. 1A and 1B, FIG. 4B illustrates a knockout step in the casting method using the mold of FIGS. 1A and 1B, and FIG. 5 illustrates in detail the propagation of two solidification fronts starting from the central zone of a molding cavity of the mold of FIGS. 1A and 1B.

DESCRIPTION OF THE EMBODIMENTS

A foundry mold 1 according to one embodiment of the invention is illustrated in FIGS. 1A and 1B. As can be seen in these figures, the mold 1, which is of the "shell mold" type, can comprise several molding cavities 2. Each of these molding cavities 2 can extend, along a first horizontal axis X, from a first end 2*a* to a second end 2*b*, in such a manner that the first horizontal axis X forms it main axis, and be formed to mold a turbine engine blade extending from a blade tip to a blade root along this first horizontal axis X. However, the technical teaching of the present disclosure are also applicable to the casting of other types of parts.

The mold 1 can also include several pairs of feeder arms, each of which can comprise a first feeder arm 3 and a second feeder arm 4. Each of these feeder arms 3, 4 can be oriented along a respective main axis in the direction of a substantially vertical axis Z. Each pair of feeder arms 3, 4 can be associated with a row off molding cavities 2 vertically offset from one another. Thus, in each row of molding cavities 2, the first end 2*a* of each molding cavity 2 can be connected to the first feeder arm 3 of the respective pair of feeder arms 3, 4 by a first docking head 5, and the second end 2*b* of each molding cavity 2 be connected to the second feeder arm 4 of the respective pair of feeder arms 3, 4 by a second docking head 6. The pairs of feeder arms 3, 4 can be laterally offset from one another in the direction of a second horizontal axis Y, substantially perpendicular to the first horizontal axis X. The molding cavities 2 can also be arranged in several rows densely occupying the volume of the mold 1. When the molding cavities 2 are configured to form turbine engine blades, the first and second docking heads 5, 6 can correspond, respectively, to the blade root and to a blade tip bead.

As illustrated, the mold 1 can have at its top a feeder 7 shaped like a funnel, connected to the tops of the feeder arms 3, 4 of each pair of feeder arms by a network of feeder channels 8.

To avoid piping defects, it is possible to apply the method of Heuvers' circles, as described for example by R. Wlodawer in *Directional Solidification of Steel Castings*, Pergamon Press, 1966, in such a manner that the area Ab of any transverse section $S_b$ of the first and second feeder arms 3, 4 of each pair, perpendicular to the vertical axis Z, is greater than the area $A_c$ of any transverse section $S_c$ of the molding cavities 2 of the corresponding row, perpendicular to the first horizontal axis X. In addition, each docking head 5, 6 can have a transverse section St with an area $A_t$, perpendicular to the horizontal axis X, greater than the area $A_c$ of any transverse section Sc of the corresponding molding cavity 2, perpendicular to the horizontal axis X, but less than the area $A_b$ of any transverse section Sb of the corresponding feeder arm 3, 4 of the first pair of feeder arms perpendicular to the vertical axis Z. Moreover, each feeder arm 3, 4 can have transverse sections Sb with area $A_b$ increasing upward along the vertical axis. As illustrated in FIG. 1A, this can be obtained with a divergence angle α of, for example, between 5 and 15° between opposite edges of the feeder arm 3, 4. Thus, as illustrated in FIG. 5, the solidification of the metal, which can be triggered within each molding cavity 2, where the transverse section is narrowest, will be able to extend until the feeder arms 3, 4 with two opposite and constantly increasing solidification fronts 10, 11, thus avoiding piping defects which can be caused by constrictions in the cavities of the mold.

Moreover, in order to limit the stresses transmitted by the mold 1 to the metal solidifying in the molding cavities 2 in the locates where they are thinnest, for example at the trailing edges of turbine engine blades, it can be contemplated that the walls of the mold 1 are thinner at these locations than at other locations of the mold 1.

A first step of the method for manufacturing the mold 1 can be the creation of a non-permanent cluster 21 comprising a plurality of patterns 22, as illustrated in FIGS. 2A and 2B. The portions of the cluster 21 intended to form hollow volumes in the mold 1, such as the patterns 22 intended to form the molding cavities 2, the vertical arms 23 intended to form the feeder arms 3, 4, the cone 24 intended to form the gate 7, and the connection 25 connecting the cone 24 and the feeder arms 3, 4 to form the feeder channels 8, can be formed of a material with a low fusion temperature such as a wax or a modeling resin. When the production of a great number of parts is considered, it is possible in particular to produce these elements by injecting wax or modeling resin into a permanent mold. In the embodiment illustrated, intended for the production of turbine engine blades, the patterns 22 show blades of this type oriented horizontally.

The non-permanent cluster 21 can also comprise refractory elements to ensure its structural integrity, such as for example descenders (not illustrated). These descenders can be located on the laterals, in order to free the space below the gate 7 to accommodate additional molding cavities 2 there, but it can also be contemplated to have only a single refractory descender located, for example, centrally under the cone 24.

To produce the mold 1 starting with this non-permanent cluster 21, it is possible to proceed with the dipping of the cluster 21 in a slurry B, as illustrated in FIG. 3A, to then dust it with a refractory sand S, i.e. granules of refractory material, as illustrated in FIG. 3B. The materials use for the slurry B and the refractory sand, as well as the granulometry of the refractory sand S can for example be those disclosed in the French patent application publications FR 2 870 147 A1 and FR 2 870 148 A1. Thus the slurry B can for example contain particles of ceramic materials, particularly in the form of flour, with a mineral colloidal binder and possibly with adjuvants depending on the rheology desired for the slurry, while the refractory sand S can also be ceramic. Among the ceramic materials which can be considered for the slurry B and/or the refractory sand S are alumina, mullite and zircon. The colloidal mineral binder can for example be a water-based colloidal mineral solution, such as for example colloidal silica. The adjuvants can comprise a wetting agent, a thinner and/or a texturing agent. These dipping and dusting steps can be repeated several times, possibly with different slurries B and sands S, until a shell C of sand impregnated with slurry is formed to a desired thickness around the cluster 21. This thickness can be adapted to different locations of the mold, for example by locally limiting some of the dusting.

The cluster 21, coated with this shell C, can then be heated, for example in an autoclave 200, to a temperature between 160 and 180° C. and at a pressure of 1 MPa to melt and remove from the interior of the shell the low-fusion-temperature material of the cluster 21. Then, in a baking step at a higher temperature, for example between 900 and 1200° C., the slurry B can solidify so as to consolidate the refractory sand S to form the refractory walls of the mold 1, as illustrated in FIG. 3C.

In a casting method using the mold 1, before proceeding with pouring the metal in the liquid state into this mold 1, it is possible to proceed with a step of preheating this mold 1, as illustrated in FIG. 4A. In this step, after introducing the mold 1 into an oven 100, the mold 1 can be heated in the oven 100, which can reach a first temperature $T_1$. Then, without removing the mold 1 from the oven 100, while maintaining the oven 100 at the first temperature $T_1$, it is possible to proceed with the pouring of the metal M in the liquid state into the mold 1, as illustrated in FIG. 4B, so as to fill the hollow volumes of the mold 1, and in particular its molding cavities 2. The metal can be poured into the mold at a second temperature $T_2$, greater than the first temperature $T_1$. However, the temperature difference ΔT between the second temperature T2 and the first temperature $T_1$ can be limited, for example no larger than 170° C., or 100° C., or even 80° C. Thus if the metal is, for example, a nickel-based equiaxial alloy of the Rene 77 type, with a solidus at 1240° C. and a liquidus at 1340° C., the second temperature $T_2$ can for example be 1450° C., and the first temperature $T_1$ then be 1350° C., with a difference ΔT no greater than 170° C. Thus, an excessive thermal shock of the melted metal poured into the mold 1, thus reducing the risk of premature and unintentional solidification of the metal in the narrowest passages of the mold 2, a solidification which could cause blockages and local defects in the parts thus produced. The pouring of the liquid metal is carried out rapidly and thus completed in a time $t_v$, which can for example be approximately 2 seconds, or even a single second.

In the following step, illustrated in FIG. 4C, the mold 1 can still be maintained in the oven 100 for a first cooling and solidification step of the metal M in the mold 1, in which the cooling rate dT/dt of the oven 100 can be controlled and limited, for example, to approximately 7° C./min at most. This upper limit to the cooling rate also allows limiting the forces exerted on the metal by the difference in thermal contraction between the mold 1 and the cooling metal. Nevertheless, the thermal contraction of the metal M, greater than that of the refractory walls of the mold 1, will cause buckling of the metal in the feeder arms 3, 4 illustrated in dotted lines in FIG. 4C, a buckling which will exert a compression stress on the metal M in the molding cavities 2, so as to balance at least partially the tension stresses caused by the thermal contraction of the metal M in the molding cavities 2. It is thus possible to avoid force concentrations which can perturb the crystallization of the metal and cause weak points in the parts resulting from this casting method.

In the embodiment illustrated, as the alloy of the Rene 77 type is a polycrystalline equiaxial alloy, the metal will form, during its solidification, a plurality of grains of substantially identical size, typically of the order of 1 mm, but with a more or less random orientation.

When the oven 100 has cooled sufficiently, until it reaches a third temperature $T_3$ of between 800° C. and 900° C. for example, it is possible to withdraw the mold 1 from the oven

100 so that it continues to cool naturally after having been placed under an insulating bell surrounded by refractory fabric, until the step of knocking-out the shell illustrated in FIG. 4D, in which the mold is destroyed to remove the solidified metal from it, comprising the turbine engine blades 100 thus formed, on which the subsequent steps of cutting out and finishing can then be carried out.

Although the present invention has been described by referring to a specific exemplary embodiment, it is clear that different modifications and changes can be carried out on this example without departing from the general scope of the invention as defined by the claims. Consequently, the description and the drawings should be considered in an illustrative, rather than a restrictive sense.

The invention claimed is:

1. A foundry mold including at least:

a first molding cavity extending, along a horizontal axis, from a first end to a second end, a first pair of feeder arms comprising:

a first feeder arm, oriented in a substantially vertical direction and connected to the first end of the first molding cavity, and a second feeder arm, substantially parallel to the first feeder arm and connected to the second end of the first molding cavity, wherein any transverse section of the first and second feeder arms of the first pair of feeder arms, perpendicular to a vertical axis, has a greater area than any transverse section of the first molding cavity perpendicular to the horizontal axis.

2. The foundry mold according to claim 1, comprising docking heads connecting the first and second ends of the first molding cavity to the respective feeder arms of the first pair of feeder arms, each docking head having a transverse section, perpendicular to the horizontal axis, with an area greater than any transverse section of the first molding cavity perpendicular to the horizontal axis, but smaller than any transverse section of the first and second feeder arms of the first pair of feeder arms perpendicular to the vertical axis.

3. The foundry mold according to claim 1, wherein the first and second feeder arms of the first pair of feeder arms have transverse sections, perpendicular to the vertical axis, with areas increasing upward along the vertical axis.

4. The foundry mold according to claim 1, comprising a first row of molding cavities, including the first molding cavity, each molding cavity of the first row of molding cavities extending, along a respective horizontal axis from a first end to a respective second end, the first end of each molding cavity of the first row of molding cavities being connected to the first feeder arm of the first pair of feeder arms, and the second end of each molding cavity of the first row of molding cavities being connected to the second feeder arm of the first pair of feeder arms.

5. The foundry mold according to claim 4, comprising at least a second row of molding cavities and a second pair of feeder arms, each molding cavity of the second row of molding cavities extending, along a respective horizontal axis, from a first end to a respective second end, the first end of each molding cavity of the second row of molding cavities being connected to the first feeder arm of the second pair of feeder arms, and the second end of each molding cavity of the second row of molding cavities being connected to the second feeder arm of the second pair of feeder arms.

6. The foundry mold according to claim 1, wherein the upper ends of the feeder arms are connected to a feeder.

7. The foundry mold according to claim 1, wherein the first molding cavity is configured to mold a turbine engine blade extending from a blade tip to a blade root along the horizontal axis.

8. The foundry mold according to claim 1, configured as a shell mold.

9. A manufacturing method for the foundry mold according to claim 8, comprising:

dipping a non-permanent pattern in a slurry;

dusting the non-permanent pattern, after dipping, with granules of a refractory material to form a layer of granules of refractory material coated with slurry;

removal of the non-permanent pattern from a shell formed by the granules of refractory material coated with slurry; and baking the shell.

10. A casting method, comprising: pouring a metal in the liquid state into the foundry mold according to claim 1;

cooling and solidification of the metal in the foundry mold; and demolding of the solidified metal.

11. The casting method according to claim 10, comprising: preheating the foundry mold in an oven prior to the pouring, and in which the mold is held in the oven until and during the pouring.

* * * * *